US005826664A

United States Patent [19]

Richardson

[11] Patent Number: 5,826,664

[45] Date of Patent: Oct. 27, 1998

[54] ACTIVE FIRE AND EXPLOSION SUPPRESSION SYSTEM EMPLOYING A RECLOSEABLE VALVE

[75] Inventor: Steven Dallas Richardson, St. Louis, Mo.

[73] Assignee: McDonnell Douglas Corporation, St. Louis, Mo.

[21] Appl. No.: 771,168

[22] Filed: Dec. 20, 1996

[51] Int. Cl.[6] ..... A62C 35/08

[52] U.S. Cl. ..... 169/46; 169/26; 169/28; 169/58; 169/61; 169/62; 169/66

[58] Field of Search ..... 169/26, 28, 46, 169/58, 61, 62, 66, 68

[56] References Cited

U.S. PATENT DOCUMENTS

| | | | |
|---|---|---|---|
| 4,702,322 | 10/1987 | Richardson | 169/28 |
| 5,031,701 | 7/1991 | McLelland et al. | 169/58 |
| 5,038,866 | 8/1991 | Kern et al. | 169/58 X |

*Primary Examiner*—Andrew C. Pike
*Attorney, Agent, or Firm*—Bell Seltzer Intellectual Property Group of Alston & Bird LLP

[57] ABSTRACT

The fire and explosion suppression system is mounted external to a tank and injects a suppressant medium into the tank via a preformed opening in the tank wall. The fire and explosion suppressant system includes a container for housing a suppressant medium which includes an opening removably connected to the predefined opening in a tank wall. The fire and explosion suppressant system also includes an actuator, such as a detonator, for activating the suppressant medium upon detection of a fire or explosion within the tank. The fire and explosion suppressant system further includes a reclosable valve for sealing the predefined opening in the tank wall. The valve includes a valve housing having at least one port and mounted over the opening in the tank wall. The valve further includes a piston disposed within the valve housing for sealing the tank wall opening. In the absence of an explosion or fire within the tank, the piston is disposed in a closed position against or within the opening in the tank wall, thereby sealing the tank wall and preventing leakage. Upon detecting a fire or explosion within the tank, however, the actuator initiates a reaction involving the suppressant medium which increases the pressure within the container and unseats the piston from the opening in the tank wall such that the suppressant medium is delivered to the tank via the ports defined by the valve housing in order to extinguish the fire or explosion.

20 Claims, 2 Drawing Sheets

ACTIVE FIRE AND EXPLOSION SUPPRESSION SYSTEM EMPLOYING A RECLOSEABLE VALVE

BACKGROUND OF THE INVENTION

The present invention relates to an active fire and explosion suppression system and method and, more particularly, to an active fire and explosion suppression system and method employing a therefore reclosable spring-loaded valve enabling multiple uses.

Fire and explosion suppression and isolation systems have gained widespread commercial use in the field of commercial/military aviation. In commercial/military aviation, fire and explosion prevention are a major design requirement since about half of all combat losses have been due to fires and explosions, while a number of commercial losses have been attributed to ground or in-flight fires and explosions as well. Fire and explosion protection are also critical to industrial applications such as petroleum or chemical storage facilities or processing plants. In particular, it was determined that as fuel tanks and petroleum storage facilities emptied, there remained an explosive fuel/air mixture susceptible to combustion caused by electrical spark or impacting ballistic threats, such as projectiles. If the volatile mixture contained within the tank or storage facility exploded, the resulting overpressure within it would cause structural failure of the tank or storage facility. It was also determined that a full or partially full fuel tank or petroleum storage facility could be ignited by a spark or impacting ballistic threat without exploding, resulting in an uncontrolled fire that can also cause structural failure of the tank or storage facility. It was also determined that many chemical processes can lead to fires due to energetic chemical reactions, again risking structural damage to the facility.

The growing field of fire or explosion suppression systems requires devices which can be readily incorporated into new construction or can be easily converted or retrofit to existing facilities without requiring structural modifications to existing storage tanks. In addition, fire or explosion suppressant systems should be able to protect a wide variety of structures, such as fuel tanks on military or commercial aircraft, land vehicles, or ships, as well as chemical storage or mixing facilities. Regardless of the application, a primary consideration in the development of fire and explosion suppression systems is to prevent, or at least limit, further penetrations into the wall or walls of such storage tanks since fuel or chemicals may be spilled either through tank penetration or leakage about a point of penetration. If spilled fuel comes into contact with an ignition source, the resulting fire can cause loss of the aircraft, for example, either through structural weakening or impingement on other flight-critical subsystems. Spilled chemicals may also create safety, environmental, or caustic hazards. However, it is often infeasible to mount fire suppressors in some areas around the tanks due to inadequate accessibility.

Conventional active fire and explosion suppression systems which are mounted within a tank and which employ flash sensors and pyrotechnically activated suppressors have significant advantages in cost and weight over traditional passive protection concepts, such as foam. In many instances, however, active suppression systems mounted within a tank are not technically feasible due to access considerations. By way of explanation, the storage of fuels, petroleum products, and chemicals typically involves facilities or structures replete with relatively inaccessible spaces. According to safety or reliability standards, pyrotechnically activated devices have to be removed and replaced on a strict time schedule, even if these devices are mounted in a relatively inaccessible space, such as within a fuel tank. For a typical aircraft application of fire and explosion suppression system inside of a fuel tank, serious problems arose because the opening of a sealed fuel tank was expensive and created a risk of leakage when the tank was resealed. In addition, some fire and explosion suppression systems include electrical lines which must extend through the wall of the tank. As will be apparent, these electrical lines create a risk of shorting or sparking and require additional tank penetrations, thereby further increasing the possibility of fuel leaks.

One conventional active suppression system which is mounted within a fuel tank includes a number of small bottles mounted inside the tank for storing a suppressant agent. This conventional suppression system also requires a distribution tube network to route the suppressant agent from the bottles through various structural partitions to ensure that a sufficient amount of the suppressant agent reached all parts of the tank to suppress any explosion before the tank was destroyed by overpressure. Although the distribution tube network could effectively route the suppressant agent throughout the tank, the distribution tube network created a time delay since the suppression system required some time to pressurize the distribution tubes once an explosion was detected. As a result, excessive pressure could build within the tank even after the explosion was detected. This conventional suppression system also required the internal structural components within the tank to be punctured at many locations in order to install and connect the various components inside the tank, as well as requiring a penetration of the outer wall to permit an electrical power line to extend to each suppressor.

Each bottle of this suppression system also generally requires a separate ignition system for firing a pyrotechnic actuator (such as a gas generator or a squib) that overpressurizes the suppressor bottle so as to burst a scored frangible disk in the delivery neck of the bottle, thereby releasing the agent. As a result, the possibility of an inadvertent short or "spark" firing the pyrotechnic actuator and accidentally releasing the agent into the tank is increased. As will be apparent, the accidental ignition of even a single bottle could cause significant structural damage to the tank if the tank was full at the time. Even if the tank was not damaged, it would be necessary to open the fuel tank to replace the discharged bottle, oftentimes a time-consuming activity given the limited access to most fuel tanks and the likelihood of creating leaks when the tank is resealed.

In order to permit greater accessibility to the fire and explosion suppression system, externally mounted suppressant delivery systems have been developed. These fire and explosion suppression systems are mounted exterior of the fuel tank or storage facility and are, therefore, relatively accessible. However, these fire and explosion suppression systems must penetrate the tank walls in order to deliver the suppressant medium. As a result, these externally mounted suppressant delivery systems also decrease the tank's structural integrity.

Examples of such fire and explosion suppression systems include those described in U.S. Pat. No. 4,702,322 (the '322 patent) to Steven D. Richardson which issued on Oct. 27, 1987, and U.S. Pat. No. 5,031,701 (the '701 patent) to Bruce McClellan et al. which issued on Jun. 16, 1991. The fire and explosion suppressant system described in the '322 patent includes an externally mounted fire and explosion suppression device incorporating a bottle of pressurized fluid suppressant agent. The pressurized bottle has a primary duct ending in a seal disposed against the exterior surface of a tank wall. The fire and explosion suppressant system of the '322 patent also includes a pyrotechnic charge disposed within a secondary duct. The secondary duct is oriented at an angle to the primary duct such that actuation of the pyrotechnic charge will cut through the seal at the end of the first duct. As a result, the fire and explosion suppressant system of the '322 patent can directly inject the suppressant into the fuel tank without requiring a distribution hose to be pressurized. Typically, the pyrotechnic charge is actuated by a flash detection device which, in turn, is activated by a fire or explosion within the tank to rupture the tank wall, and release the suppressant into the tank.

Therefore, while it would be desirable to mount a fire and explosion suppressant system exterior of the fuel tank or other structure in order to permit inspection and recharging of the fire and explosion suppressant system, conventional fire and explosion suppressant systems developed for exterior mounting, such as those described by the '322 and '701 patents, still suffer from a number of deficiencies. For example, conventional fire and explosion suppressant systems which are externally mounted puncture the tank wall in order to deliver the suppressant. As a result, the hole in the tank wall must be repaired and the debris created by the puncture of the tank wall must be removed from the tank prior to refilling the tank. While the creation of a hole in the wall of a fuel tank is a nuisance which must be repaired, holes created in the wall of other tanks or containers may create additional problems. For a firefighting system associated with a reacting vat containing a corrosive or toxic mix of chemicals, the creation of a hole in the vat wall and the resulting leakage could result in injury to nearby personnel or firefighters.

SUMMARY OF THE INVENTION

It is therefore an object of the invention to provide an improved method and apparatus for suppressing fire and explosions in tanks or similar structures having limited access.

It is another object of the present invention to provide an improved method and apparatus for suppressing fires or explosions in tanks or similar structures in a safe manner.

It is a further object of the invention to provide a fire and explosion suppression system and method which reduces the damage to the tank or other structures.

It is a more specific object of the invention to provide an improved method and apparatus for suppressing fires and explosions in tanks or other structures which does not create a hole in the tank wall which must subsequently be repaired prior to refilling the tank.

These and other objects are provided, according to the present invention, by a suppression system and method which is mounted external to a tank and which injects suppressant into the tank via a preformed opening in the tank wall. As a result, the fire and explosion suppression system and method of the present invention prevents unnecessary punctures of the tank wall, averts post-activation leakage, eradicates the need for post-activation repairs to the tank wall, and does not require debris generated by the puncture of the tank wall to be removed from the tank.

The system includes a container for housing a suppressant medium which includes an opening removably connected to a predefined opening in a tank wall such that the tank and container are in fluid communication. The fire and explosion suppressant system also includes actuation means, such as a detonator, for activating the suppressant medium upon detection of a fire and/or an explosion within the tank. According to the present invention, the fire and explosion suppressant system further includes a valve for sealing the predefined opening in the tank wall. The valve includes a valve housing having at least one port and mounted over the opening in the tank wall. The valve further includes a piston disposed within the valve housing for sealing the tank wall opening. Thus, in the absence of an explosion or fire within the tank, the piston is disposed in a closed position against or within the opening in the tank wall, thereby sealing the tank wall and preventing leakage.

In one preferred embodiment, the valve housing is internally mounted within the tank and the container is externally mounted on the tank. As a result, the container can be readily inspected and replaced without requiring the tank to be unsealed.

The valve is preferably a therefore reclosable valve. Thus, the piston disposed within the valve housing reseals the opening in the tank after the suppressant medium has entered the tank and the pressure between the tank and the external container has equalized. In this regard, the valve can also include a spring for urging the piston towards the wall of the tank such that the piston seals the opening in the tank wall during normal operational conditions.

The fire and explosion suppressant system of one embodiment also includes a sensor for detecting explosions within the tank. When the sensor detects an explosion within the tank, the sensor triggers the actuation means which, in turn, causes the pressure within the container to rise. In embodiments which include a frangible disc covering the opening in the tank wall, the increased pressure within the container ruptures the frangible disc, overcomes the force exerted by the spring and opens the valve, thus allowing the suppressant to escape through the ports defined by the valve housing and to flood the interior of the tank so as to suppress the explosion. When the pressure within the container is sufficiently reduced, the valve is returned to a closed position such that the opening in the tank wall is sealed. For example, the spring can urge the piston toward the tank wall and into a closed position in one advantageous embodiment.

In one advantageous embodiment, the spent extinguisher assembly remains outside of the tank for easy access and replacement. In this regard, the internally mounted valve housing containing the spring-loaded valve readily accepts the reattachment of another bottle of suppressant agent. Furthermore, by placing the valve housing inside the tank and over the predefined opening in the tank wall, no damage is done to the tank wall. Apart from a simple inspection to verify the tank's internal condition, no repair or reconstruction of the tank wall is required following actuation of the fire and explosion suppressant system, thereby reducing or eliminating the risk of post actuation leakage. In addition, no debris must be cleared or removed from the tank since actuation of the fire and explosion suppression system does not puncture another hole in the tank wall.

Since the fire and explosion suppression system of the present invention is self-repairing in a manner which maintains the integrity of the tank wall, actuation of the fire and explosion suppression system does not permit much, if any, of the contents of the tank to escape. As a result, the fire and explosion suppression system significantly reduces the safety hazards to which technicians or firefighters are exposed during actuation of the suppression system or, thereafter, during replacement or refilling of the container. In addition, since the valve closes automatically as the respective pressures within the container and the tank equalize, the fire and explosion suppression system reduces any flow back into the container which further reduces the hazards involved in handling, transporting, and refurbishing the container.

DETAILED DESCRIPTION OF THE INVENTION

Various methods and apparatus embodiments of the invention are set forth below. This invention may, however, be embodied in many different forms and should not be construed as limited to the embodiment set forth herein. To the contrary, the invention includes numerous alternatives, modifications, and equivalents as will become apparent from consideration of the present specification including the drawings, the foregoing discussion, and the following detailed description.

Figure 1:
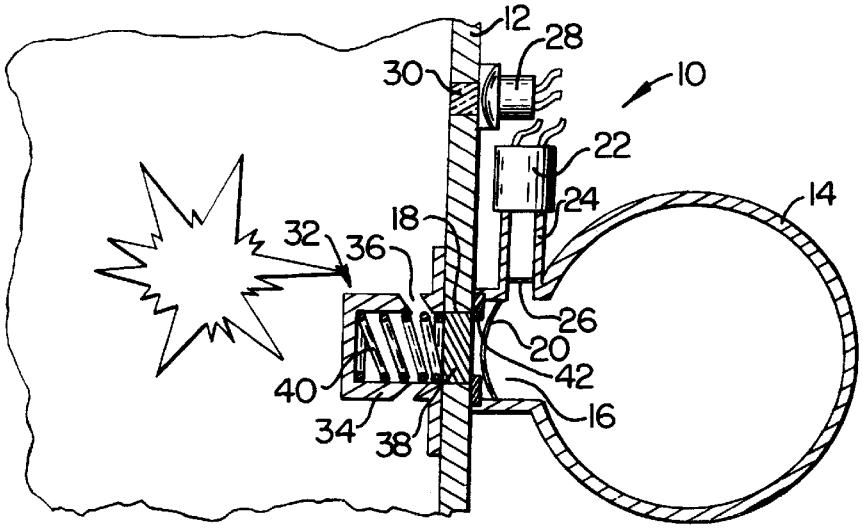
FIG. 1 is a cross-sectional view of an explosion suppressant device according to one embodiment of the present invention which includes a container housing an explosion suppressant medium and mounted to the exterior of a tank, such as a fuel tank.

Referring now to FIG. 1, a fire and explosion suppressant system 10 according to one embodiment of the present invention is illustrated. As shown, the fire and explosion suppressant system is mounted to the wall 12 of a tank so as to be exterior of the tank. While described in conjunction with a fuel tank, the fire and explosion suppressant device can also be used in conjunction with storage tanks or other closed structures or tanks without departing from spirit and scope of the present invention.

The fire and explosion suppressant system 10 includes a container or bottle 14 containing a fire or explosion suppressant medium, such as any of the Halon alternatives now being qualified under the Montreal Protocol including, but not limited to, FE-25/HFC-125, CF31, and water-based agents. The container defines an opening 16. As shown in FIG. 1, the container is mounted to the tank wall 12 such that the opening defined by the container faces the tank wall. The tank wall also defines an opening 18. As a result, the fire and explosion suppressant system is mounted to the tank wall such that the respective openings in the container and the tank wall are aligned and in fluid communication. In particular, the opening defined by the container is preferably sealed over the opening defined by the tank wall.

The opening 16 defined by the container 14 is typically sealed such that the suppressant medium is held within the container. As shown in FIG. 1, the opening defined by the container can be sealed with a frangible disc 20. In one advantageous embodiment, the frangible disc which seals the opening defined by the container is a thin metal disc which has been scored, such as in an X-shaped pattern, to facilitate the rupture of the frangible disc once the pressure within the container exceeds a predetermined threshold.

The fire and explosion suppressant system 10 also includes actuation means, such as a detonator 22 or a fast-acting solenoid, for initiating a reaction involving the suppressant medium within the container 14. For example, the detonator of the illustrated embodiment is a pyrotechnic squib connected to the container via a duct 24. As shown in FIG. 1, the duct is also preferably sealed to separate the detonator from the contents of the container prior to activation of the detonator. For example, the duct can be sealed with a frangible disc 26. The frangible disc of one embodiment is a thin disc, such as a thin metal disc, which has been scored, such as in an X-shaped pattern. The frangible disc sealing the duct is designed such that the disc will rupture upon activation of the detonator such that a reaction involving the explosion suppressant medium can be initiated. While the fire and explosion suppressant system of the illustrated embodiment includes a frangible disc sealing the duct, the actuation means could, instead, include a shaped charge disposed outside of the container such that actuation of the shaped charge cuts directly through the container.

The fire and explosion suppressant system 10 of one embodiment also includes a sensor 28, such as an optical detector element or a flash sensor, for detecting a fire or explosion within the tank. Upon detecting a fire or explosion, the sensor provides a predetermined type of electrical signal. The sensor can be directly connected to the actuation means, such as the detonator 22, such that the detonator is activated by the electrical signal generated by the sensor in response to detecting a fire or explosion. Alternatively, the sensor can be operably connected to a controller which receives the electrical signal generated by the sensor in response to the detected fire or explosion and which, in turn, signals the detonator to discharge, thereby activating the detonator.

Although the sensor 28 can be mounted in a variety of fashions relative to the tank without departing from the spirit and scope of the present invention, the sensor of one advantageous embodiment is disposed adjacent a transparent window 30 mounted within the tank wall 12. Alternatively, the sensor can be mounted within the tank.

While the illustrated embodiment of the fire and explosion suppressant system 10 includes a sensor 28, the actuation means can be triggered in a number of other manners without departing from the spirit and scope of the present invention. For example, the actuation means can be triggered by a fiber optic sensor network, a pressure sensor, a temperature sensing device such as a "fire wire", or by manual activation.

Figure 5:
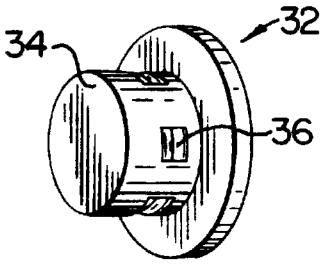
FIGS. 5 and 6 are perspective views from opposite sides of one embodiment of the valve of the explosion suppressant device of the present invention.
Figure 6:
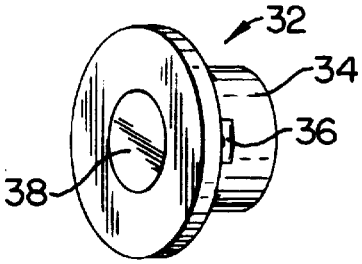

The fire and explosion suppressant system 10 also includes a valve 32 mounted to the tank wall 12 and over the opening 18 defined thereby. As shown in FIG. 1, the valve is preferably mounted within the tank and over the opening defined by the tank wall. As shown in more detail in FIGS. 5 and 6, the valve includes a valve housing 34 defining at least one port 36. Although the valve housing need only define a single port, the valve housing of one advantageous embodiment defines a plurality of ports spaced circumferentially and uniformly around the valve housing.

The valve 32 further includes a piston 38 disposed within the valve housing 34 and moveable between open and closed positions as described hereinafter. In the closed position, the piston preferably seals the opening 18 defined by the tank wall 12. As shown in FIG. 1, the piston can seal the opening by seating within and filling the opening. Although not shown, an 0-ring can be disposed within a groove defined by the tank wall that extends circumferentially about and opens into the opening in order to provide a tighter seal between the tank wall and the piston of this embodiment. Alternatively, the piston can seal the opening by covering the opening, but not seating within the opening.

In the illustrated embodiment, the valve 32 also includes a spring 40 for urging the piston 38 toward the tank wall 12, i.e., toward the closed position, with a predetermined force. However, the valve can include other means, including hydraulic means, for urging the valve toward the closed position without departing from the spirit and scope of the present invention with respect to the illustrated embodiment, the spring is preferably selected to provide a predetermined force which will hold the piston in the closed position such that the piston will seal the opening 18 defined by the tank wall 12 until sufficient pressure is built within the container 14, such as by a reaction of the suppressant medium in response to the detection of a fire or explosion within the tank, to rupture the frangible disc 20 which has sealed the opening of the container, at which time the piston is urged toward the open position as described hereinafter. In order to properly seat the piston within the opening defined by the tank wall, the fire and explosion suppressant system 10 of FIG. 1 can also include a stop, such as a snap ring 42, disposed within a groove defined by the portion of the container adjacent the tank wall to prevent the piston from being overextended.

The operation of the fire and explosion suppressant system 10 will be described with reference to the embodiment illustrated in FIGS. 1–4. In FIG. 1, the sensor 28 detects an ignition flash of a fire or explosion within the tank and provides an electrical signal, either directly to the actuation means or to a controller which, in turn, notifies the actuation means as described above. While the operation of the fire and explosion suppressant system is described in conjunction with a sensor, the actuation means can be triggered in other manners as described above without departing from the spirit and scope of the present invention.

Figure 2:
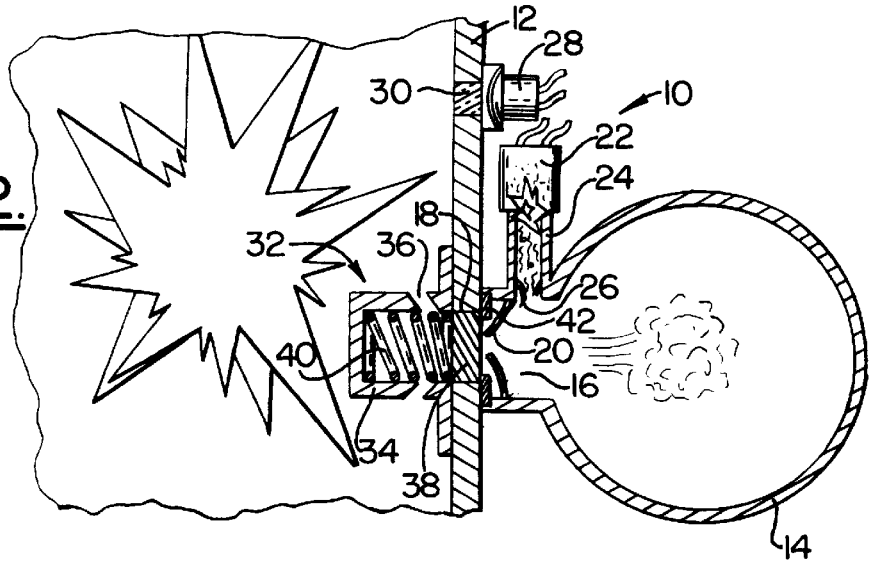
FIG. 2 is a cross-sectional view of the explosion suppressant device of the embodiment of FIG. 1 which illustrates the detonation of the detonator in response to an explosion within the tank.

In response to the electrical signal provided by the sensor 28, the actuation means, such as a detonator 22, is activated, such as by detonating the pyrotechnic squib. In the embodiment of FIG. 2, the activation of the detonator ruptures the frangible disc 26 which has sealed the duct 24 connecting the detonator to the container 14. As also shown in FIG. 2, the activation of the detonator initiates a reaction of the suppressant medium which, in turn, increases the pressure within the container. Once the pressure within the container exceeds the predetermined threshold, the frangible disc 20 which seals the opening 16 of the container is ruptured.

Figure 3:
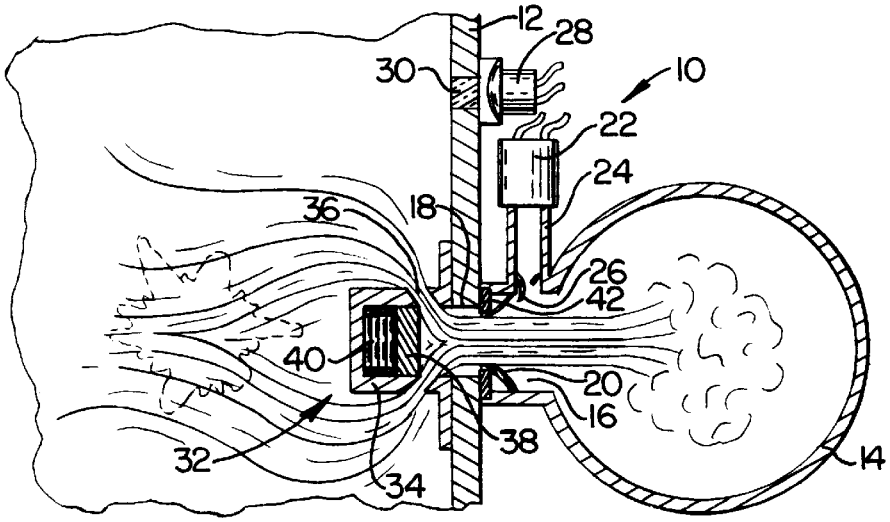
FIG. 3 is a cross-sectional view of the explosion suppressant device of the embodiment of FIG. 1 which illustrates the delivery of the explosion suppressant medium via openings defined by the valve housing.

Once the frangible disc 20 which has sealed the opening 16 of the container 14 is ruptured, the pressure created within the container overcomes the predetermined force exerted by the spring 40 and urges the piston 38 from the closed position shown in FIG. 2 to the open position shown in FIG. 3. Once the piston is unseated, the suppressant medium enters the internal chamber defined by the valve housing 34, escapes through the ports 36 defined by the valve housing, and floods the tank, thereby extinguishing the fire or explosion within the tank that was previously detected by the sensor 28.

Figure 4:
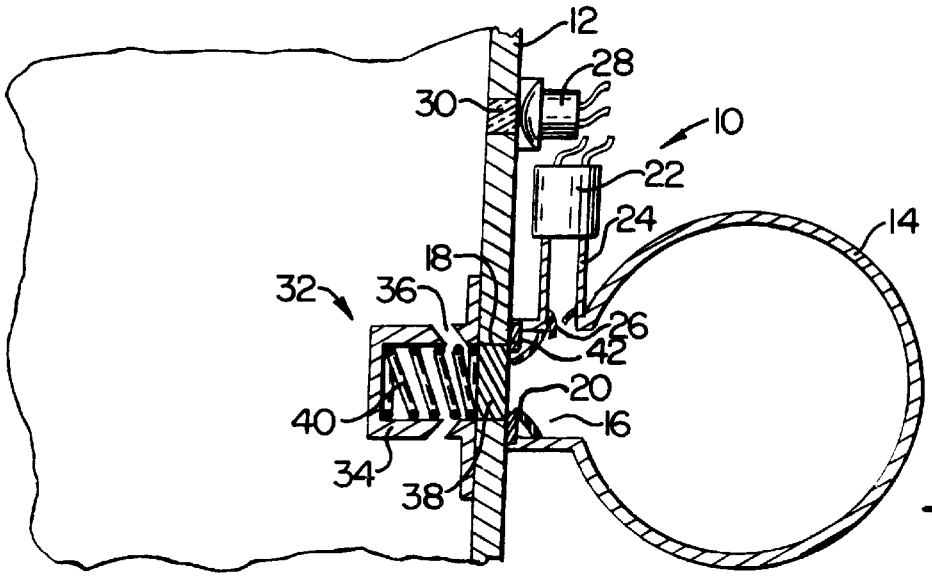
FIG. 4 is a cross-sectional view of the explosion suppressant device of the embodiment of FIG. 1 which illustrates the resealing of the valve over the opening defined by the tank wall following delivery of the explosion suppressant medium.

As shown in FIG. 4, the valve 32 is therefore reclosable such that the opening 18 in the tank wall 12 can be resealed once the respective pressures within the tank and within the container 14 have equalized. Typically, the respective pressures within the tank and the container equalize once the suppressant medium has been delivered and the explosion or fire within the tank has been extinguished. According to the illustrated embodiment, the spring 40 urges the piston 38 from the open position shown in FIG. 3 to the closed position shown in FIG. 4 once the suppressant medium has been delivered.

Accordingly, the fire and explosion suppressant system 10 controllably introduces a suppressant medium into a tank, such as a fuel tank, to extinguish a fire or explosion that has been detected within the tank. However, the fire and explosion suppressant system of the present invention includes a therefore reclosable valve 32 for resealing the opening 18 defined within the tank wall 12. As a result, the opening need not be repaired within the tank wall following actuation of the fire and explosion suppressant system. Since the activation of the fire and explosion suppressant system does not create an additional hole in the tank wall, the fire and explosion suppressant system of the present invention does not create tank wall debris which must be removed from the tank as described above in conjunction with conventional fire and explosion suppressant systems. Thus, the fire and explosion suppressant system of the present invention can be readily inspected and replaced following activation without repairing the tank wall or otherwise opening the tank, thereby reducing the possibility of tank leakage.

Since the fire and explosion suppression system 10 of the present invention is self-repairing in a manner which maintains the integrity of the tank wall 12, actuation of the fire and explosion suppression system does not permit much, if any, of the contents of the tank to escape. As a result, the fire and explosion suppression system significantly reduces the safety hazards to which technicians or firefighters are exposed during actuation of the suppression system or, thereafter, during replacement or refilling of the container 14. In addition, since the valve closes automatically as the respective pressures within the container and the tank equalize, the fire and explosion suppression system reduces any flow back into the container which further reduces the hazards involved in handling, transporting, and refurbishing the container.

Many modifications and other embodiments of the invention will come to the mind of one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed is:

1. A system for suppressing a fire or explosion within a tank, the system comprising:

a container for housing a suppressant medium under pressure, said container defining an opening, said container being mounted to a wall of the tank such that the opening of said container is in fluid communication with a predefined opening in the wall of the tank;

actuation means, operably connected to said container, for initiating a reaction of the suppressant medium to increase the pressure within said container; and a valve mounted to the wall of the tank for closing the predefined opening in the tank, said valve comprising a valve housing mounted over the predefined opening in the tank, said valve housing defining at least one port;

a piston, disposed within said valve housing, for sealing the predefined opening in the wall of the tank; and a spring disposed within said valve housing for urging said piston towards the wall of the tank;

wherein said actuation means initiates the reaction of the suppressant medium in response to the fire or explosion within the tank to displace said piston within said valve housing such that the suppressant medium enters the tank via the at least one port and suppresses the fire or explosion.

2. A system according to claim 1 wherein said valve is a reclosable valve such that said piston reseals the predefined opening in the wall of the tank following entry of the suppressant medium into the tank and pressure equalization between said container and the tank.

3. A system according to claim 1 wherein said valve is mounted to an interior surface of the wall of the tank, and wherein said container is mounted to an exterior surface of the wall of the tank.

4. A system according to claim 1 wherein said valve housing defines a plurality of ports spaced both circumferentially and uniformly about said valve housing.

5. A system according to claim 1 wherein the predefined opening in the wall of the tank has a predetermined size and shape and wherein said piston has a corresponding size and shape which matches the predetermined size and shape of the predefined opening such that said piston fits snugly within the predefined opening.

6. A system according to claim 1 further comprising a sensor, operably connected to said actuation means, for detecting the fire or explosion within the tank.

7. A system according to claim 1 further comprising a frangible disk covering the opening of said container, wherein said frangible disk is fractured as a result of the increase in the pressure within said container initiated by said actuation means.

8. A system according to claim 1 wherein said actuation means is a detonator.

9. A system for suppressing a fire or explosion within a tank, the system comprising:

a container for housing a suppressant medium under pressure, said container defining an opening, said container being mounted to a wall of the tank such that the opening of said container is in fluid communication with a predefined opening in the wall of the tank;

actuation means, operably connected to said container, for initiating a reaction of the suppressant medium to increase the pressure within said container; and a reclosable valve mounted to the wall of the tank for repeatedly closing the predefined opening in the tank, said valve comprising a valve housing mounted over the predefined opening in the tank, said valve housing defining at least one port; and a piston disposed within said valve housing and having an open position and a closed position, wherein said piston, in the closed position, seals the predefined opening in the wall of the tank and wherein said piston, in the open position, establishes fluid communication between said container and the tank via the at least one port;

wherein said actuation means initiates the reaction of the suppressant medium in response to the fire or explosion within the tank to move said piston from the closed position to the open position such that the suppressant medium enters the tank via the at least one port and suppresses the fire or explosion.

10. A system according to claim 9 wherein said piston returns from the open position to the closed position to reseal the predefined opening in the wall of the tank following entry of the suppressant medium into the tank and pressure equalization between said container and the tank.

11. A system according to claim 9 wherein said reclosable valve is mounted to an interior surface of the wall of the tank, and wherein said container is mounted to an exterior surface of the wall of the tank.

12. A system according to claim 9 wherein said valve housing defines a plurality of ports spaced both circumferentially and uniformly about said valve housing.

13. A system according to claim 9 wherein the predefined opening in the wall of the tank has a predetermined size and shape and wherein said piston has a corresponding size and shape which matches the predetermined size and shape of the predefined opening such that said piston fits snugly within the predefined opening.

14. A system according to claim 9 further comprising a sensor, operably connected to said actuation means, for detecting a fire or explosion within the tank.

15. A system according to claim 9 further comprising a frangible disk covering the opening of said container, wherein said frangible disk is fractured as a result of the increase in the pressure within said container initiated by said actuation means.

16. A method for suppressing a fire or explosion within a tank with a fire and explosion suppressant system comprising a container for housing a suppressant medium under pressure, said container defining an opening and mounted to a wall of the tank such that the opening of said container is in fluid communication with a predefined opening in the wall of the tank, the fire and explosion suppressant system further comprising a valve mounted to the wall of the tank for closing the predefined opening in the tank, said valve comprising a valve housing defining at least one port and mounted over the predefined opening in the tank, said valve further comprising a piston disposed within said valve housing, said method comprising of the steps of:

sealing the predefined opening in the wall of the tank with the piston;

detecting a fire or explosion within the tank while the predefined opening is sealed;

initiating a reaction of the suppressant medium in response to the detected fire or explosion to thereby increase the pressure within the container;

opening the valve, following said initiating step in response to the increased pressure within the container, wherein said opening step comprises removing the piston from the predefined opening;

introducing the suppressant medium into the tank via the at least one port once the valve is opened; and resealing the predefined opening with the piston following introduction of the suppressant medium into the tank and pressure equalization between said container and the tank.

17. A method according to claim 16 wherein the fire and explosion suppressant system further comprises a frangible disk covering the opening of the container, and wherein the method further comprises the step of fracturing the frangible disk prior to said opening step and following said initiating step in response to the increased pressure within the container.

18. A method according to claim 16 wherein said introducing step comprises suppressing the detected fire or explosion within the tank.

19. A system for suppressing a fire or explosion within a structure, the system comprising:

a container for housing a suppressant medium under pressure, said container defining an opening, said container being mounted to a wall of the structure such that the opening of said container is in fluid communication with a predefined opening in the wall;

actuation means, operably connected to said container, for initiating a reaction of the suppressant medium to increase the pressure within said container; and a reclosable valve mounted to the wall for repeatedly closing the predefined opening in the wall, wherein said valve has an open position in which fluid communication is established between said container and the structure, and wherein said valve has a closed position in which the predefined opening in the wall is sealed;

wherein said actuation means initiates the reaction of the suppressant medium in response to the fire or explosion within the structure so as to move said reclosable valve from the closed position to the open position such that the suppressant medium enters the structure via the predefined opening in the wall and suppresses the fire or explosion.

20. A method for suppressing a fire or explosion within a structure with a fire and explosion suppressant system comprising a container for housing a suppressant medium under pressure, said container defining an opening and mounted to a wall of the structure such that the opening of said container is in fluid communication with a predefined opening in the wall, the fire and explosion suppressant system further comprising a reclosable valve mounted to the wall for closing the predefined opening in the wall, said method comprising of the steps of:

sealing the predefined opening in the wall with the valve;

detecting a fire or explosion within the structure while the predefined opening is sealed;

initiating a reaction of the suppressant medium in response to the detected fire or explosion to thereby increase the pressure within the container;

opening the reclosable valve, following said initiating step, in response to the increased pressure within the container to thereby establish fluid communication between the container and the structure;

introducing the suppressant medium into the structure via the predefined opening in the wall once the valve is opened; and resealing the predefined opening with the reclosable valve following introduction of the suppressant medium into the structure and pressure equalization between the container and the structure.

* * * * *